US005884264A

United States Patent [19]

Ortiz

[11] Patent Number: 5,884,264

[45] Date of Patent: Mar. 16, 1999

[54] IDENTIFYING MECHANICAL DAMAGE USING SOUND SAMPLES

[75] Inventor: Jose Ortiz, Bronx, N.Y.

[73] Assignees: Peter C. Michalos, Englewood Cliffs; John J. Lampidis, Fort Lee, both of N.J.

[21] Appl. No.: 853,119

[22] Filed: May 8, 1997

[51] Int. Cl.[6] ..... G10K 15/02

[52] U.S. Cl. ..... 704/270; 381/61

[58] Field of Search ..... 381/61; 704/270; 73/579; 345/117

[56] References Cited

U.S. PATENT DOCUMENTS 5,586,187 12/1996 Webb ..... 381/61
5,646,340 7/1997 Gee et al. ..... 73/116

OTHER PUBLICATIONS

"Windows 95 Uncut" IDG books Worldwide, p. 542, 1995.

*Primary Examiner*—David R. Hudspeth
*Assistant Examiner*—Harold Zintel
*Attorney, Agent, or Firm*—Notaro & Michalos P.C.

[57] ABSTRACT

An arrangement and method for identifying mechanical damage in a mechanism having a multiplicity of different sections which generate different actual sounds due to damage in each section, uses a sound sample storage for storing a sound sample of each of the different actual sounds. A selector is connected to the sound sample storage for selecting one of the sound samples corresponding to a section which is suspected of being damaged. A sound generator generates the sound sample selected by the selector, to make the sound sample audible, for use in comparing the sound sample to the actual sound of the section which is suspected of being damaged, for identifying the section which is damaged if the actual sound is similar to the audible sound sample.

5 Claims, 1 Drawing Sheet

IDENTIFYING MECHANICAL DAMAGE USING SOUND SAMPLES

FIELD AND BACKGROUND OF THE INVENTION

The present invention relates, in general, to the repair of mechanical systems and devices, and in particular, to a new and useful arrangement and method which is particularly suited to aiding in the repair of vehicles. The invention can be applied to any mechanism, however, which is capable of generating different sounds caused by damage in different parts, systems or sections of the mechanism.

Automobiles, trucks and all other vehicles specifically and mechanisms, in general, suffer from periodic damage due to wear, mechanical failure, accident or other reasons. Often, the operator of the vehicle first becomes aware of the existence of the damage because of the generation of an unusual sound. Although occasionally, the operator can associate the sound with a specific type of damage, more often the operator can, at best, identify the general area in the vehicle where the sound is coming from, but does not know what specific type of damage is causing the sound.

For the purpose of this disclosure, the term "damage" is being used to identify any condition in any section of a mechanism which causes a sound, which is outside the normal sound, generated by the mechanism. The term is not limited to mechanical breakage, but includes parts which are out of alignment, parts which are still operating but are badly worn, or any other non-nominal condition in any section of the mechanism. The term "mechanism" is used to identify not only vehicles such as automobiles, trucks, all-terrain vehicles, flying vehicles or floating vehicles, but also any other mechanical device or system, such as knitting and weaving machines, manufacturing machines (e.g. numeric control machines, industrial robots, etc.), conveying and material handling systems, and any other collection of moving parts which are put together to achieve a desired function. The term "section" is used to identify individual parts, combinations of parts, systems including multiple combinations of parts, and other collections of one or more mechanical elements which may move or through which or past which fluids may move, and which can thus generate an audible sound.

Returning to the specific case of the automotive industry, when the unrecognizable new sound occurs, the operator often brings his or her vehicle to a mechanic and then attempts to reproduce the sound or describe the sound to the mechanic to help the mechanic identify the damage. Many times, the vehicle is no longer making the sound at the time it is brought to the mechanic so that even this is eliminated as a source of information to aid the mechanic to locate the damage.

SUMMARY OF THE INVENTION

An object of the present invention is to provide an arrangement and method which takes advantage of the unique sounds generated by damage in various sections of a mechanism, in general, or a vehicle specifically, to aid in identifying the damaged section.

Accordingly, another object of the present invention is to provide an arrangement for identifying mechanical damage in a mechanism having a multiplicity of different sections which generate different actual sounds due to damage in each section, the arrangement comprising: sound sample storage means for storing a sound sample of each of the different actual sounds; selector means connected to the sound sample storage means for selecting one of the sound samples corresponding to a section which is suspected of being damaged; and a sound generator connected to the sound sample storage means for generating the sound sample selected by the selector means, to make the sound sample audible, for use in comparing the sound sample to the actual sound of the section which is suspected of being damaged, for identifying the section which is damaged if the actual sound is similar to the audible sound sample.

A further object of the present invention is to provide a method for identifying mechanical damage in a mechanism having a multiplicity of different sections which generate different actual sounds due to damage in each section, the method comprising: storing a sound sample of each of the different actual sounds; selecting one of the sound samples corresponding to a section which is suspected of being damaged; and generating the sound sample selected to make the sound sample audible, for use in comparing the sound sample with the actual sound for identifying the section which is damaged if the actual sound is similar to the audible sound sample.

A still further object of the present invention is to provide an arrangement and method which is simple in design, rugged in construction and economical to manufacture using known and readily available technology.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

Figure 1:
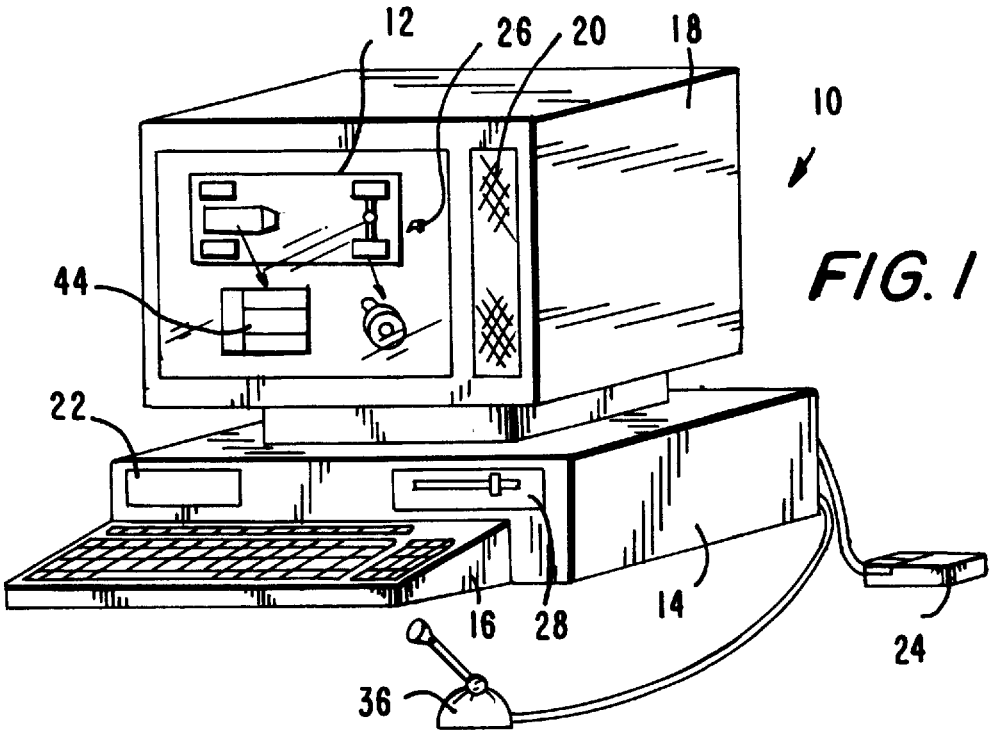
Figure 2:
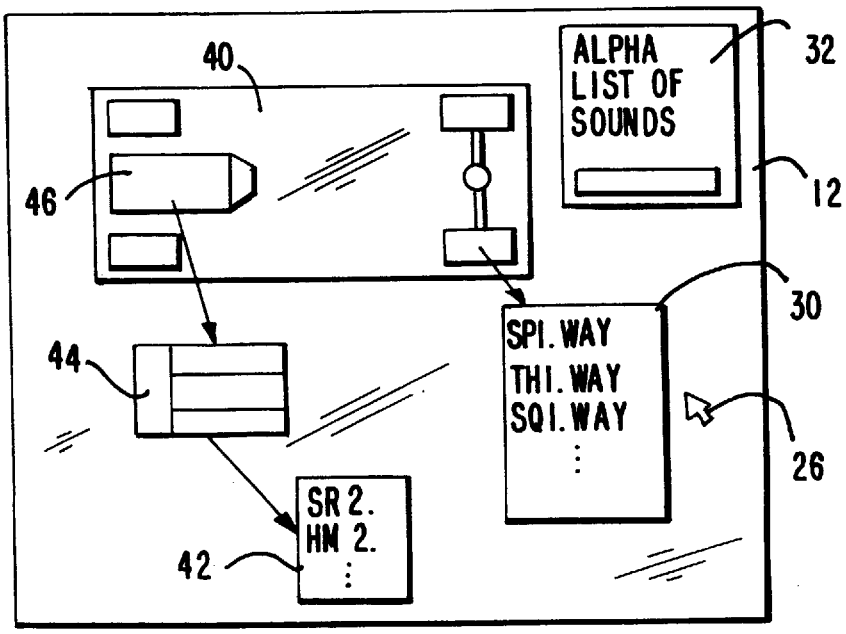

IN THE DRAWINGS:

FIG. 1 is a perspective view of a personal computer or PC, provided and used in accordance with the present invention; and FIG. 2 is an enlarged schematic view of an example of a screen display generated according to the present invention.

DESCRIPTION OF THE PREFERRED EMBODIMENTS

Referring to the drawings and particular, the invention embodied in FIG. 1, comprises an arrangement generally designated 10, used for identifying mechanical damage in a mechanism, such as an automobile schematically depicted on screen 12, the mechanism having a multiplicity of different sections such as power train, suspension, cabin and the like, which generates different actual sounds due to damage in each section. Arrangement 10 is advantageously a personal computer or PC comprising a cabinet 14 containing a CPU, storage mechanisms, peripheral I/O mechanisms, power supplies and the like, a key board 16 for inputting data, commands or inquiries into the personal computer, and a monitor 18 for displaying information to the user on the screen 12. Personal computer 10 also includes a speaker having an output shown at 20 and appropriate hardware and software for storing and reproducing audible sounds. Currently, PC's are provided with hard drives shown schematically at 22 which store programs to operate the PC as well as sound storage and reproduction programs. Internally, the cabinet 14 also contains a sound card which contains hardware that is capable of converting digitally stored information into audible sounds generated through speaker 20. One example is the commercially available hardware plus software combination known as "Sound-Blaster 16" (a trademark).

Currently, it is common to save sound samples in a computer file with a name having the general format "filename.wav". The extension ".wav" is identified by the software as being a sound sample with the word "filename" being selected by the user to help the user identify the sound sample.

Another piece of hardware shown in FIG. 1, which is particularly useful for the present invention is a mouse 24 electrically connected to the computer and movable to move a curser or pointing arrow 26 across the surface of screen 12. Another useful periphery for use with the arrangement 10 in FIG. 1, is a floppy disc drive 28, which can receive a floppy disc which contains various sample sounds that have been accumulated, for example, in the field, for helping store the multiplicity of sounds in the computer arrangement 10.

Although a desk-top computer is shown, as an example of arrangement 10, it is understood that a lap-top or palm-top computer may also be used. As will be explained later in this disclosure, the present invention is not limited to computer equipment and can be practiced using other devices as well.

To prepare arrangement 10 for use, a multiplicity of sounds or sound samples are accumulated and stored, for example, in the form of the "filename.wav" format, in hard-drive 22. The sounds can be accumulated by a mechanic in a busy shop where many different types of damage producing many different types of actual sounds are available for recording. It is important, however, that each sound be clearly associated and identified with a particular type of damage so that it can be later retrieved and reproduced to the vehicle operator who will either recognize it as the sound that the vehicle is producing, or as not being that sound. This will allow the mechanic to eliminate problems.

Display 12 can be used if the operator can locate the general vicinity of the sound. Otherwise, the operator can describe the general type of sound such as whether it was a knocking sound, a rattle sound, a tapping sound, etc.

The arrangement and method of the present invention has been developed in order to maximize the ability of the mechanic to quickly and accurately locate the probable source of the sound in the form of damage to a particular section, based either on the operator's ability to generally locate the source of the sound or otherwise characterize the sound in non-technical terms.

To further increase the reliability of the invention, the mechanic is given the ability to reproduce the sound so that it can be heard by the operator. If the operator recognizes the reproduced sound as being the actual sound that the operator heard, then the mechanic can examine the section from which the sound most likely came from to determine the nature of the damage. If the sound generated by the arrangement does not sound like the sound the operator heard, then a new sound can be selected and the process repeated until the most probable match is located. As an example of a scenario which can utilize the present invention, an operator operating his or her vehicle hears a sound which sounds like it's coming from the rear left wheel area of the automobile. Referring to FIGS. 1 and 2, the operator utilizes mouse 24 to move the curser 26 to the location corresponding to a left rear wheel on a schematic image of an automobile displayed on screen 12. By clicking one of the buttons on the mouse, a menu box 30 is opened revealing a list of sound sample file names such as SP1.WAV (indicating a scrape sound which in turn is known to be caused by either suspension, wheel dust cover, weak springs, or weak shocks and struts). Menu box 30 may include additional sounds which can be characterized as a scrape sound labelled for example as SP1.WAV, SP2.WAV, etc. Sound from the left rear wheel may also be a thumping sound, with the sample being identified as "TH1.WAV", corresponding also to a suspension problem. Alternatively, a squeak sound may have been produced (SQ1.WAV) corresponding to struts. The squeak may also be produced by shocks, door panels, dash board or seat, and perhaps, was mis-identified by the user but, in fact, still was a squeaking sound. These different sound samples can be labelled SQ2.WAV, SQ3.WAV, SQ4.WAV and SQ5.WAV, and be available to the operator under a menu system 32 which can be clicked to produce an alphabetical listing of sounds by the word which most closely characterizes the sound.

The display and menu system which can be shown on screen 12 may also include the possibility of enlarging or expanding a sub-system of multiple sections, such as an engine shown small at 46 and expanded at 44, which can be enlarged, so that the pointer can be placed on different parts of the engine such as tappet cover, oil pan or other engine part. If clicked on the various engine part, then another sub-menu of sample sounds similar to menu 42 in FIG. 2 can be produced on the display 12.

Here again, the sub-section is clicked or the file name is inputted by keyboard 16, to eventually generate the sound which the user has tried to identify to the mechanic, for the user to listen to and tell the mechanic whether, in fact, the reproduced sound sample is similar to the actual sound heard by the user, thus helping identify the source of the damage, or different from the sound, necessitating reselection of another sample sound.

The apparatus and method of the present invention, thus, gives the mechanic a valuable tool in helping the vehicle operate, in effect, help the mechanic to locate the sound and thus, minimize wasted effort and maximize the chance of accurately identifying the source of the sound and thus, the location of the damage, for rapid repair.

Arrangement 10, if in the form of a lap-top computer with microphone 36, can be taken into the shop when new sounds are located corresponding to different damage, and recorded in the form of an appropriate file name, and then stored in the hard drive 22 or provided in the form of a floppy disc inserted into floppy drive 28 for storage into arrangement 10. Software which can be developed by those having ordinary skill in programming as it is currently developed, can add the sound to the appropriate menu box 30 and/or 32 corresponding to the appropriate location in the schematic automobile image 40 or alphanumeric list, or place the new recorded sound in an appropriate sub-menu 42, which pops up only after a subsystem, for example, the enlarged engine icon 44, is generated by clicking on the engine 46 in the schematic representation 40. So called "hypertext" programs can be utilized to permit this type of multiple accessing from system to system and from menu to menu, again to facilitate a rapid identification of the sound that the vehicle operator heard.

The following table lists a variety of sounds, keyed to possible file names and causes, which can be recorded, stored and used in accordance with the present invention.

| SOUND | FILE NUMBER | CAUSE |
|---|---|---|
| Knocking | KN1.WAV | Bearings |
| | KN2.WAV | Lifters |
| | KN3.WAV | Loose Flywheel |
| Rattle | RT1.WAV | Loose components inside engine compartment |
| | RT2.WAV | Loose components from suspension |
| | RT3.WAV | Loose exhaust assembly |
| Tapping | TP1.WAV | Lifters |
| | TP2.WAV | Injectors |
| | TP3.WAV | Bearings |
| | TP4.WAV | Loose pulley |
| Ticking | TK1.WAV | Injectors |
| | TK2.WAV | Lifters |
| | TK3.WAV | Loose Wheel Caps |
| Pinging | PG1.WAV | Fuel octane |
| | PG2.WAV | Timing |
| | PG3.WAV | E.G.R. valve |
| | PG4.WAV | Emission control units |
| Popping | PP1.WAV | Fuel starvation |
| | PP2.WAV | Poor ignition |
| | PP3.WAV | Timing |
| Clank | CL1.WAV | Loose drive pulley |
| | CL2.WAV | Loose exhaust assembly |
| Creak | CR1.WAV | Suspension |
| | CR2.WAV | Broken or cracked suspension bushings |
| | CR3.WAV | Loose or cracked door hinges |
| | CR4.WAV | Loose hood support brackets |
| Scrape | SP1.WAV | Suspension |
| | SP2.WAV | Wheel dust cover |
| | SP3.WAV | Weak springs and shocks/struts |
| Rumble | RB1.WAV | Water pump |
| | RB2.WAV | Power steering pump |
| | RB3.WAV | Air pump |
| Roaring | RR1.WAV | Loose or cracked exhaust |
| | RR2.WAV | Power steering pump |
| Humming | HM1.WAV | Power steering pump |
| | HM2.WAV | Air pump |
| | HM3.WAV | Torque converter |
| Screech | SR1.WAV | Loose drive belts |
| | SR2.WAV | Loose drive pulleys |
| Squeaks | SQ1.WAV | Struts |
| | SQ2.WAV | Shocks |
| | SQ3.WAV | Door panels |
| | SQ4.WAV | Dashboard |
| | SQ5.WAV | Seats |
| Hissing | HS1.WAV | Loose vacuum lines |
| | HS2.WAV | Leaking manifold |
| | HS3.WAV | Intake assembly |
| Thump | TH1.WAV | Suspension |
| Clunk | CK1.WAV | Strut mounts |
| | CK2.WAV | Struts |
| | CK3.WAV | Shocks |
| | CK4.WAV | Bushings |
| Erratic | ER1.WAV | Emission components |
| Idle | ER2.WAV | Carburetor |
| | ER3.WAV | Fuel injection system |
| Surging | SU1.WAV | Fuel injection |
| | SU2.WAV | Leaking intake |
| Winding | WD1.WAV | Power steering pump |
| | WD2.WAV | Torque converter |
| Whistle | WS1.WAV | Loose drive belts |
| | WS2.WAV | Loose pulleys |
| | WS3.WAV | Speedometer cable |
| Exhaust | EX1.WAV | Cracked or broken exhaust pipe |
| | EX2.WAV | Catalytic converter |
| | EX3.WAV | Muffler |
| Brake | BK1.WAV | Worn disc pads |
| | BK2.WAV | Worn rotors |
| Running Water | WT1.WAV | Water pump |

As noted above, although a computer is the best mechanism currently known for storing and reproducing the various sound samples, an audio tape recorder can also be used for storing the samples in sequence and then reproducing the samples to the vehicle operator. Here, it is essential that the mechanic have a good index and collection of the sounds being reproduced to the user so as to correlate each sound with an appropriate section of the automobile.

Another embodiment of the invention used a sound recognition program in the PC, of the type known for voice recognition, to automatically identify an unknown sound from a mechanism, as being similar to a stored sound in the memory to identify the source of sound and thus the damage.

While a specific embodiment of the invention has been shown and described in detail to illustrate the application of the principles of the invention, it will be understood that the invention may be embodied otherwise without departing from such principles.

What is claimed is:

1. An arrangement for identifying mechanical damage in a mechanism having a multiplicity of different sections which generate different actual sounds due to damage in each section, the arrangement comprising:

sound sample storage means for storing a sound sample of each of the different actual sounds;

selector means connected to said sound sample storage means for selecting one of said sound samples corresponding to a section which is suspected of being damaged; and a sound generator connected to said sound sample storage means for generating the sound sample selected by said selector means, to make the sound sample audible, for use in comparing the sound sample to the actual sound of the section which is suspected of being damaged, for identifying the section which is damaged if the actual sound is similar to the audible sound sample;

said sound sample storage means, selector means and sound generator being included in a personal computer, said sound sample storage means comprising a digital storage in said computer, and said selector means and sound generator comprising a combination of programming and hardware in said personal computer, said computer including a visible display, said computer being programmed with means for generating schematic images of the mechanism on the display and menu means for selecting an area of the schematic mechanism display and producing a list of at least one sound sample corresponding to a sound sample for said area, stored in the sound sample storage means, selectable by the selector means to generate sound through the sound generator.

2. An arrangement according to claim 1, wherein the mechanism is a vehicle, the schematic image including a schematic image of a power train, suspension and enclosure of the vehicle.

3. An arrangement according to claim 1, including alphabetical means connected to the selector means for displaying an alphabetical listing of sound samples stored in the sound sample storage means.

4. A method for identifying mechanical damage in a mechanism having a multiplicity of different sections which generate different actual sounds due to damage in each section, the method comprising:

storing a sound sample of each of the different actual sounds;

selecting one of said sound samples corresponding to a section which is suspected of being damaged; and generating the sound sample selected for use in comparing the sound sample with the actual sound for identifying the section which is damaged if the actual sound is similar to the audible sound sample;

selecting a second one of the sound samples which is different from the first selected sound sample if the first selected sound sample is not similar to the actual sound, generating the second selected sound sample to make the second sound sample audible for use in comparing the second sound sample with the actual sound for identifying the section which is damaged, and repeating the selecting of new sound samples and the generating of the new sound samples until the last selected sound sample is similar to the actual sound; and visually displaying a schematic image of the mechanism and selecting a location corresponding to a section which is suspected of being damaged, selecting the location causing selection of a group of at least one sound samples for the step of selecting the one of said sound samples corresponding to a section which is suspected of being damaged in said location.

5. A method according to claim 4, including selecting the sample using a computer sound recognition program.

* * * * *